US007458328B2

(12) United States Patent
Hall

(10) Patent No.: US 7,458,328 B2
(45) Date of Patent: Dec. 2, 2008

(54) HINGE MECHANISM

(75) Inventor: Geoffrey Hall, Teversal Village (GB)

(73) Assignee: Abacus Holdings Limited, Nottinghamshire (GB)

( * ) Notice: Subject to any disclaimer, the term of this patent is extended or adjusted under 35 U.S.C. 154(b) by 7 days.

(21) Appl. No.: 11/720,045

(22) PCT Filed: Nov. 28, 2005

(86) PCT No.: PCT/GB2005/004525

§ 371 (c)(1),
(2), (4) Date: May 23, 2007

(87) PCT Pub. No.: WO2006/059072

PCT Pub. Date: Jun. 8, 2006

(65) Prior Publication Data

US 2008/0127872 A1 Jun. 5, 2008

(30) Foreign Application Priority Data

Nov. 30, 2004 (GB) ..... 0426208.5

(51) Int. Cl.
*B63H 9/10* (2006.01)

(52) U.S. Cl. ..... 114/91; 52/116

(58) Field of Classification Search ..... 114/90, 114/91, 97; 52/111, 112, 116, 117, 118, 52/119

See application file for complete search history.

(56) References Cited

U.S. PATENT DOCUMENTS

| | | | | | |
|---|---|---|---|---|---|
| 4,016,823 | A | * | 4/1977 | Davis | 114/90 |
| 4,020,606 | A | * | 5/1977 | Pratt | 52/116 |
| 4,121,530 | A | * | 10/1978 | Arce | 114/91 |
| 4,592,177 | A | | 6/1986 | Pratt | |
| 4,875,424 | A | * | 10/1989 | Baldwin | 114/91 |
| 5,058,336 | A | * | 10/1991 | Jenvey | 52/116 |
| 5,280,760 | A | * | 1/1994 | Edwards | 114/91 |

OTHER PUBLICATIONS

International Preliminary Report on Patentability dated Oct. 25, 2006.
International Search Report from EPO dated Aug. 2, 2006.

* cited by examiner

*Primary Examiner*—Lars A Olson
(74) *Attorney, Agent, or Firm*—Young Basile

(57) ABSTRACT

A hinge mechanism comprises first and second chock plates and an adjustable shaft. Each of the chock plates includes an aperture in the form of a figure of eight, the first and second circular portions of which are similar and are connected by a neck portion of a width less than the diameter of the circular portions. The shaft is longitudinally adjustable between a first retracted position in which the sections of the shaft aligned with each of the chock plates have a cross-section which corresponds to the circular portion of the aperture and a second extended position in which the sections of the shaft aligned with each of the chock plates have a cross-section of a diameter which is less than the width of neck portion.

4 Claims, 13 Drawing Sheets

HINGE MECHANISM

BACKGROUND OF THE INVENTION

The present invention relates to an improved hinge, in particular to a hinge for a lighting mast of the type which comprises an upper mast portion and a base, which upper mast portion is rotatable about a horizontal pivot axis in the base of the mast.

The present invention further rotates to an improved arrangement for the raising and lowering of masts, in particular lighting masts, which require to be raised and lowered for repair and routine maintenance.

In known mast systems, for example those described in GB Patent No 2 349 653, unauthorised lowering of the mast is prevented by the combination of a docking system preventing lowering of the mast when the docking system is engaged, a locking system manually operable selectively to allow or prevent disengagement of the docking system and a hinge operable to allow pivoting of the mast when the locking system is unlocked and the docking system is disengaged.

Currently available systems for raising and lowering masts of this type, for example the systems described in in GB Patent No 2 349 653, are manually operated and controlled, rather than automatic, and are suitable for use with the previously used smaller systems, but are not ideally suited for the raising and lowering of the larger systems, because of the need for manual intervention by an operator working in close proximity to the base of the mast.

It is an object of the present invention to provide a hinge mechanism in which the above disadvantages are reduced or substantially obviated.

SUMMARY OF THE INVENTION

The present invention provides a hinge mechanism which comprises first and second chock plates and an adjustable shaft, each of the chock plates including an aperture in the form of a figure of eight, the first and second circular portions of which are similar and are connected by a neck portion of a width less than the diameter of the circular portions and the shaft is longitudinally adjustable between a first retracted position in which the sections of the shaft aligned with each of the chock plates have a cross-section which corresponds to the circular portion of the aperture, and a second extended position in which the sections of the shaft aligned with each of the chock plates have a cross-section the diameter of which is less than the width of the neck portion.

In a preferred embodiment of a hinge according to the invention, the shaft comprises a set of two cam rams, one mounted at either end of a pivot shaft, each of the cam rams comprising a cylinder, a ram shaft which extends through the cylinder and is slideable therein and a circular cam plate mounted on a first end of the ram shaft, the ram shaft having a diameter less than the width of the neck portion and the cam plate having a cross-section which corresponds to a circular portion of the figure of eight aperture.

The present invention further provides an arrangement for the raising and lowering of a mast, which comprises an upper mast portion and a base, which upper mast portion is rotatable about a horizontal pivot axis, located in the base of the mast, which arrangement comprises (i) docking means for restraining the upper mast portion against rotation;

(ii) attachment means for attaching drive means for driving the docking means between a first engaged configuration wherein the upper mast portion is restrained against rotation and a second disengaged configuration wherein the upper mast portion is free to rotate and (iii) locking means selectable via an intermediate unlocked configuration between a first locked figuration wherein the docking means is engaged and a second unlocked configuration wherein the docking means is disengaged characterised in that the locking means comprises a hinge mechanism which comprises first and second chock plates and an adjustable shaft, each of the chock plates including an aperture in the form of a figure of eight, the first and second circular portions of which are similar and are connected by a neck portion of a width less than the diameter of the circular portions and the shaft is longitudinally adjustable between a first retracted position in which the sections of the shaft aligned with each of the chock plates have a cross-section which corresponds to the circular portion of the aperture, and a second extended position in which the sections of the shaft aligned with each of the chock plates have a cross-section the diameter of which is less than the width of the neck portion.

In a preferred embodiment of the arrangement according to the invention the shaft comprises a set of two cam rams, one mounted at either end of a pivot shaft, each of the cam rams comprising a cylinder, a ram shaft which extends through the cylinder and is slideable therein and a circular cam plate mounted on a first end of the ram shaft, the ram shaft having a diameter less than the width of the neck portion and the cam plate having a cross-section which corresponds to a circular portion of the figure of eight aperture.

BRIEF DESCRIPTION OF THE DRAWINGS

A hinge according to the invention and an arrangement for the raising and lowering of a lighting mast will now be described with reference to the accompanying drawings in which.

DETAILED DESCRIPTION

Figure 1:
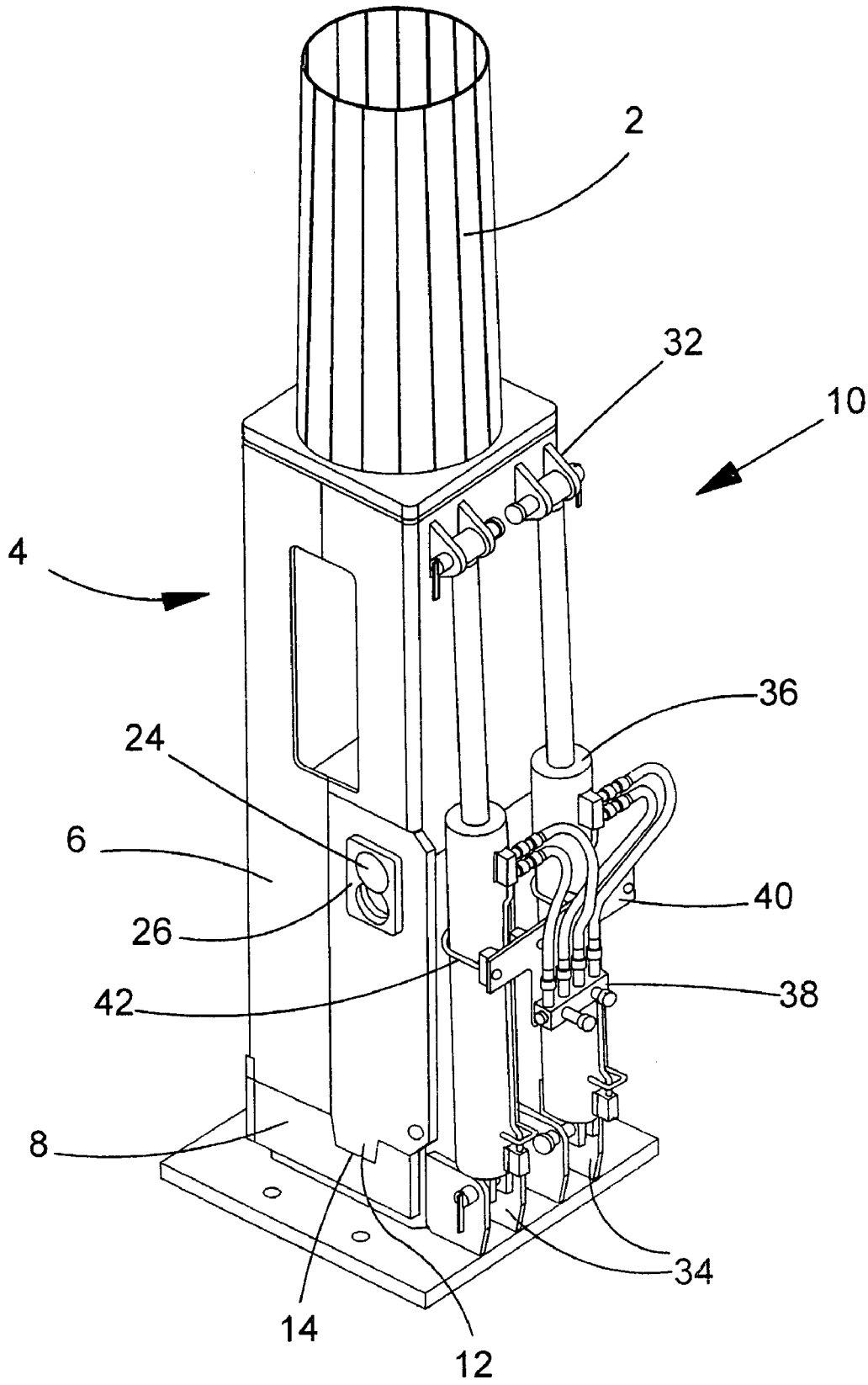
FIG. 1 is a perspective view of a mast (upper mast portion truncated) in the raised, docked and locked position, with hydraulic lift rams attached.

As can be seen from FIG. 1, a mast shown generally at 10 comprises an upper mast portion 2 and a base portion 4. The upper mast portion 2 is in the form of a hollow tapering cylinder and is shown truncated in the drawings.

The base portion 4 comprises an upper base portion 6 and a lower base portion 8. The upper base portion 6 is in the form of a substantially hollow square section box. The upper mast portion 2 extends into the upper base portion 6 and is secured thereto. The lower base portion 8 is secured to the ground (not shown). A docking latch 12 is formed at the lower end of the upper base portion 6, for engagement with a co-operating notch 14 in the upper end of the lower base portion 8.

As can be seen more clearly in FIGS. 1 to 5, a horizontal pivot axis 16 extends through the upper base portion 6 and terminates at each end in a cam ram 18, each of which cam rams 18 comprises a cylinder 20, a shaft 22 which extends through the cylinder 20 and is slidable therein and a cam plate 24 mounted on a first end of the shaft 22. The diameter of the shaft 22 varies along its length. The second end of the shaft 22 terminates in a spigot 29 of smaller diameter than the shaft 22 and projects through an aperture in the end of the cylinder 20 remote from the cam plate 24. One external end face only of one cam plate 24 is visible in FIG. 1.

A mounting groove 27, the function of which will be described below, is provided in the outer wall of the cylinder 20. The cylinder 20 is further provided in a manner known per se with an inlet 20' and an outlet 20" for the supply and removal of hydraulic fluid.

A chock plate 26, having an aperture 28 in the form of a figure of eight, is provided on a side wall of the upper base portion 6. A similar chock plate 26 is located on the opposite sidewall of the upper base portion 6 in alignment with the first chock plate 26.

Each circular portion of the figure of eight aperture 28 has an internal diameter corresponding to the diameter of the cam plate 24.

Figure 3:
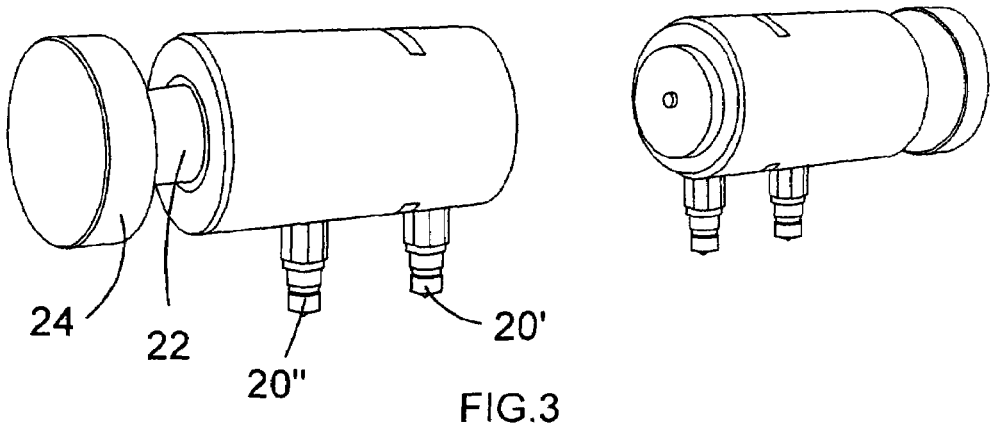
FIG. 3 is a view corresponding to FIG. 2, with the rams extended.
Figure 5:
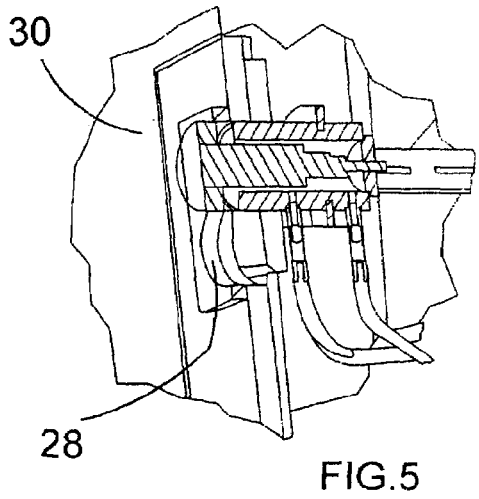
FIG. 5 is a view corresponding to FIG. 2, with the ram extended.

In the position shown in FIGS. 1, 3 and 5, the cam plate 24 of the cam ran 18 engages in the upper circular portion of the figure of eight aperture 28.

The neck portion of the aperture 28 is sized so as to allow the shaft 22 of the cam ram 18 to pass freely between the circular portions of the aperture 28.

Figure 2:
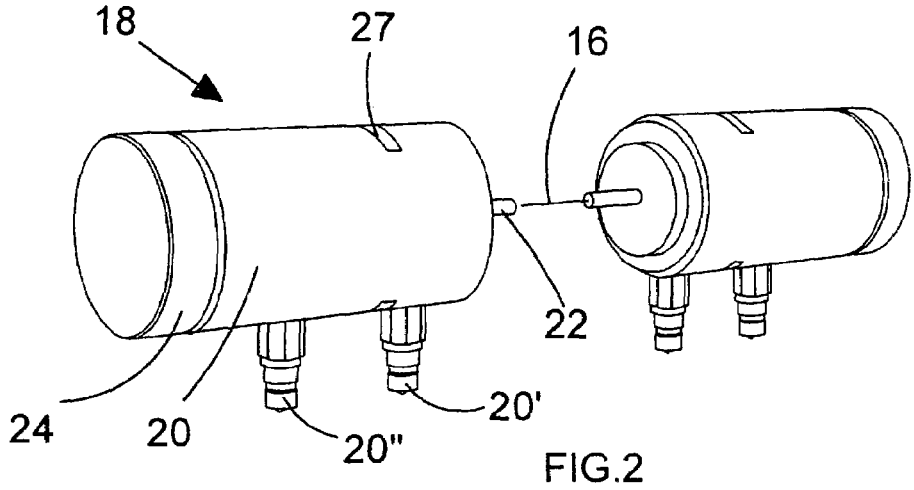
FIG. 2 is a perspective view of a pair of cam rams, with the rams retracted.

In the configuration shown in FIG. 2, the cam ram 18 is in the retracted configuration, with the cam plate 24 in contact with the cylinder 20.

Figure 4:
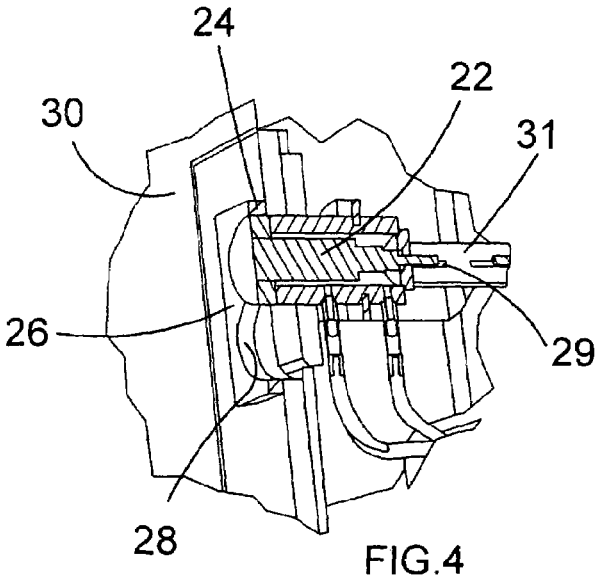
FIG. 4 is a perspective view of a hinge assembly, including a ram according to FIG. 2, forming part of a mast according to Figure, with the ram retracted.

As can be seen from FIG. 4, the shaft 22 extends through the cylinder 20. The cam plate 24 is mounted on the free end of the shaft 22.

In the configuration shown in FIG. 3, the cam ram 18 is in the extended configuration, with the cam plate 24 spaced from the cylinder 20 and supported by the shaft 22.

FIGS. 4 and 5 show a cam ram according to FIGS. 2 and 3, in situ in a lighting mast as shown in FIG. 1. A mounting bracket 31 for sensors, the function of which will be described later, is located within the upper base portion 6.

In the configurations shown in FIGS. 1, 4 and 5, the cam ram 18 is shown aligned vertically with the upper circular portion of the aperture 28, which corresponds to the raised, docked and locked position of the mast 10.

In the configuration shown in FIG. 5, the cam ram 18 is in the extended configuration, with the cam plate 24 spaced from the cylinder 20 and supported by the ram shaft 22.

The upper base portion 6 of the mast 10 includes a collar 33 for mounting engagement in the mounting groove 27.

In the position shown in FIG. 1, the cam plate 24 of the cam ram 18 engages in the upper circular portion of the figure of eight aperture 28.

The neck portion of the aperture 28 is sized so as to allow the shaft 22 of the cam ram 18 to pass freely between the circular portions of the cam ram 18. Upper U-shaped mounting brackets 32 and lower mounting brackets 34 are located on the upper base portion 6 and lower base portion 8 respectively, for receiving lift ram cylinders 36. The left ram cylinders 36 are supplied in a manner known per se by a manifold 38 mounted on a bracket 40 secured to the cylinders 36 by means of yokes 42.

In FIG. 1, the hydraulic ram cylinders 36 are shown in a partially extended configuration with the mast in a raised, docked and locked position.

Figure 6B:
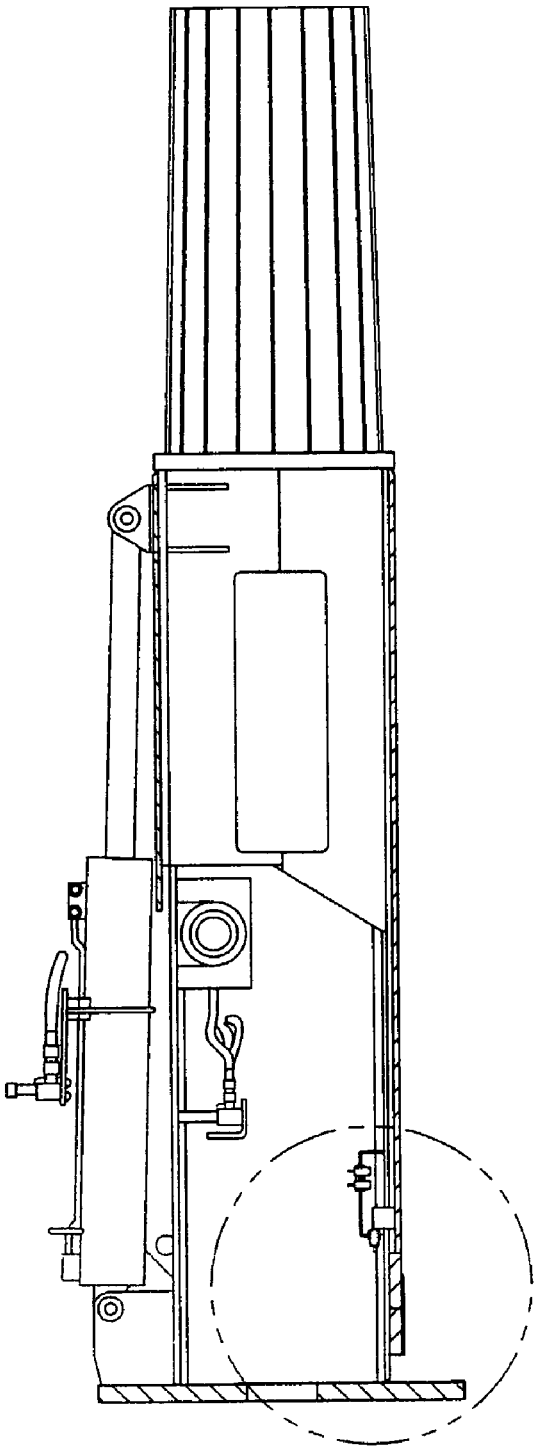
FIG. 6*b* is a section on the line B-B of FIG. 6*a;*
Figure 6A:
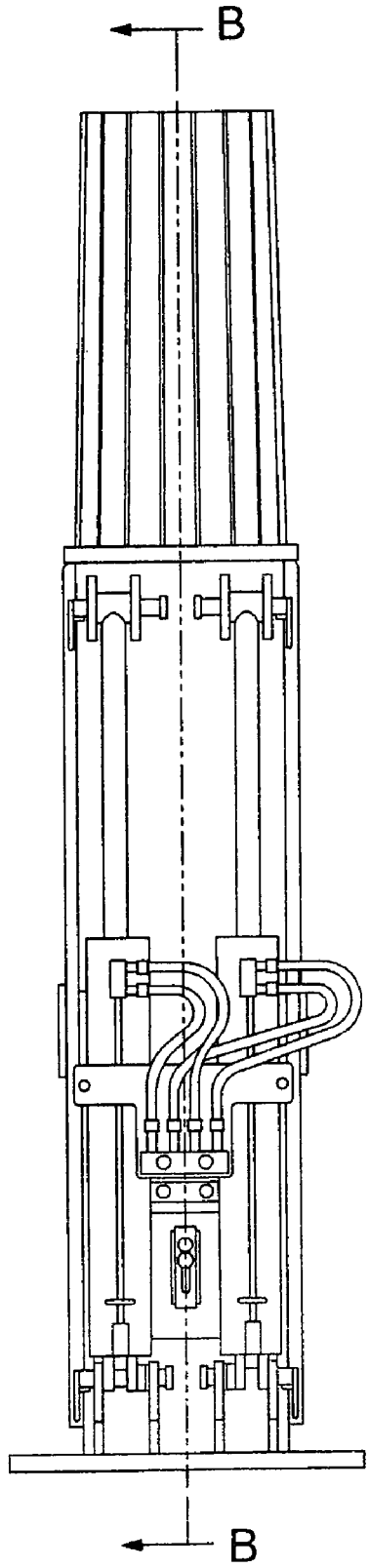
FIG. 6*a* is a view of the attachment face of a mast of FIG. 1 in the raised, docked and locked position, with hydraulic lift rams attached.

FIG. 6*a* is a view of the mast of FIG. 1 in the same configuration, but showing the attachment face 44 of the upper base portion 6.

A second manifold 46, for supply to the cam ram 18 is provided.

Figure 6D:
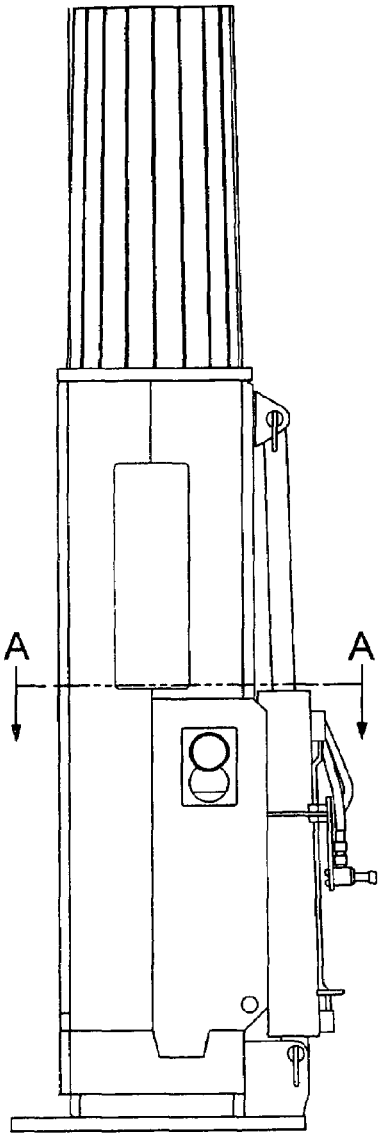
FIG. 6*d* is a side view of the mast of FIG. 6*a;*
Figure 6C:
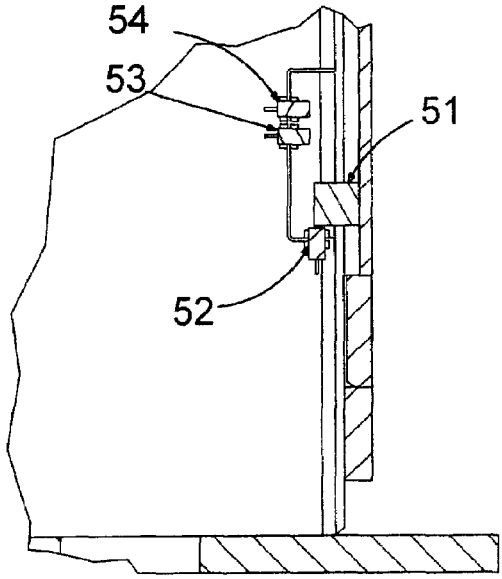
FIG. 6*c* is an enlarged view of the region C of FIG. 6*b;*
Figure 6E:
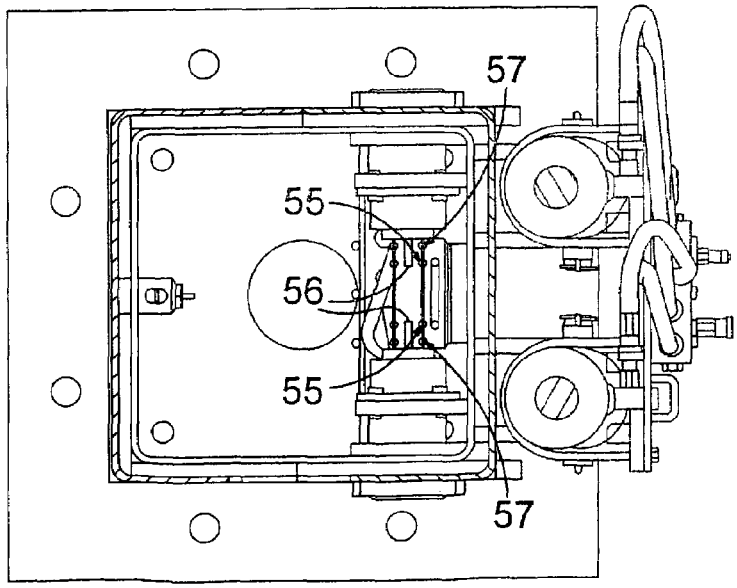
FIG. 6*e* is a section on the line A-A of FIG. 6*d;*

As can be seen from FIGS. 6*c* and 6*e*, the mast is provided with a plurality of sensors S1 to S8, which have the following functions:

Sensors S1 and S2 together sense the start of the extension of the lift rams 36 and full closure of these rams;

Sensors S1 and S3 together sense the vertical alignment of the mast 10;

Sensors S1 and S4 together sense the full extension of the lift rams 36 and the start of closure of these rams;

Sensors S5, S6 and S7 together sense the extension and closure of the cam rams 18;

Sensors S1, S2 and S4 together sense the engagement/disengagement of the docking latch 12 relative to the notch 14 and Sensor S8 senses the proximity to the ground of the lowered mast.

Figure 7B:
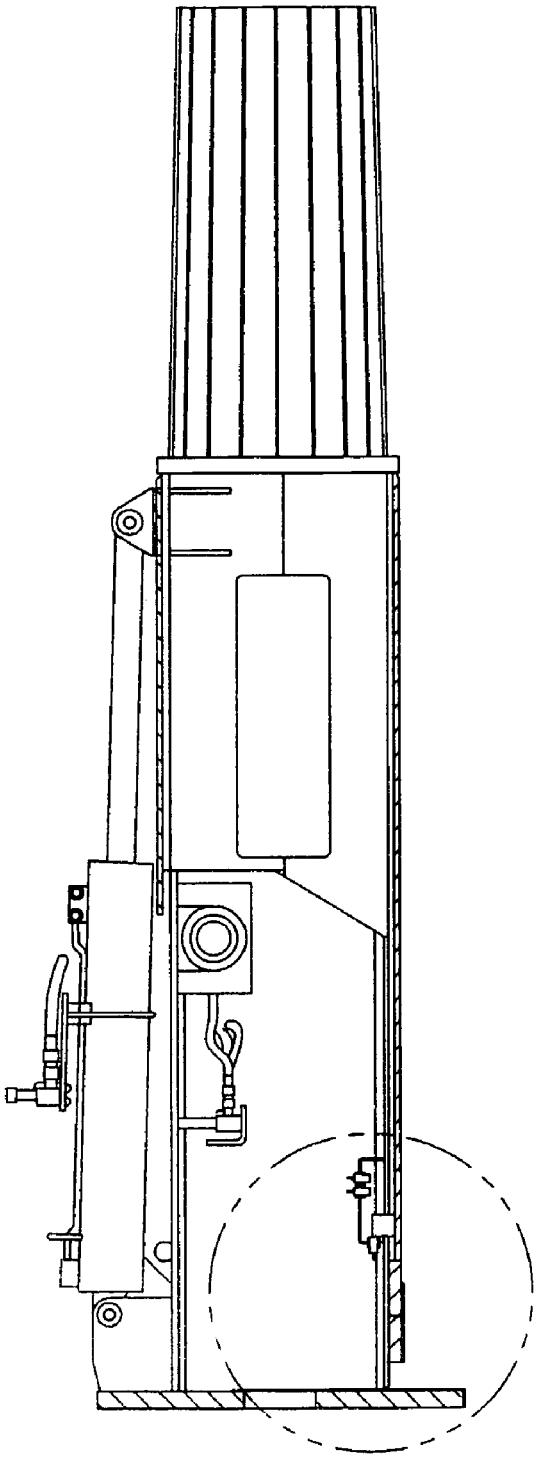
FIGS. 7*a* to 7*e* are views corresponding to FIGS. 6*a* to 6*e* in the raised, docked and unlocked position.
Figure 7A:
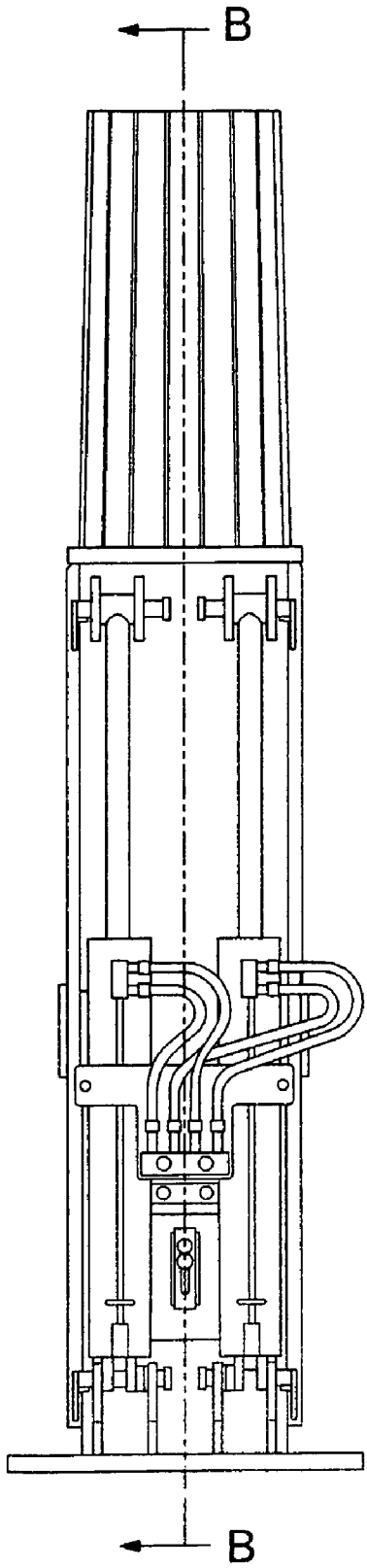
Figure 7D:
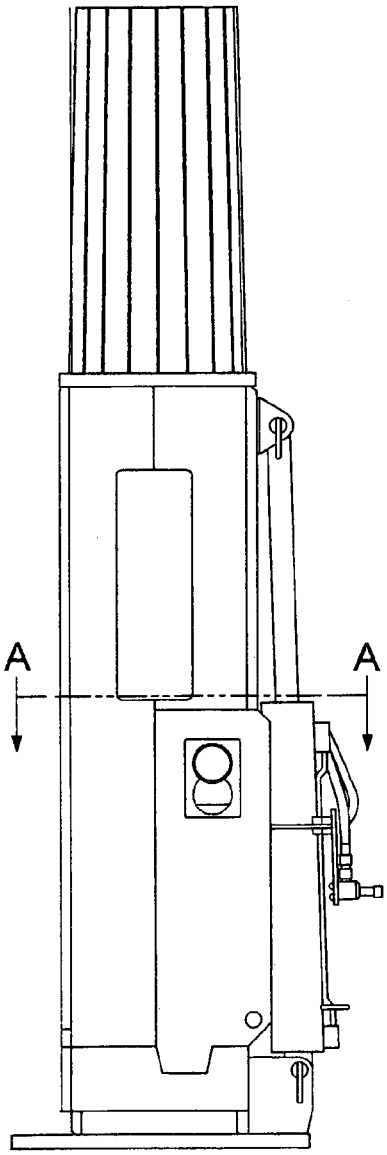
Figure 7C:
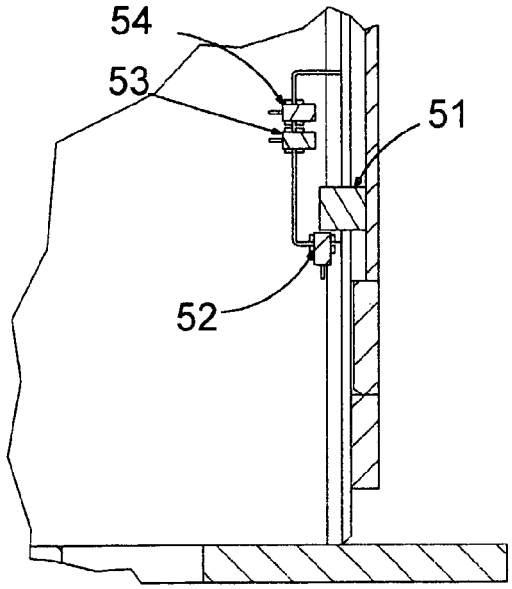
Figure 7E:
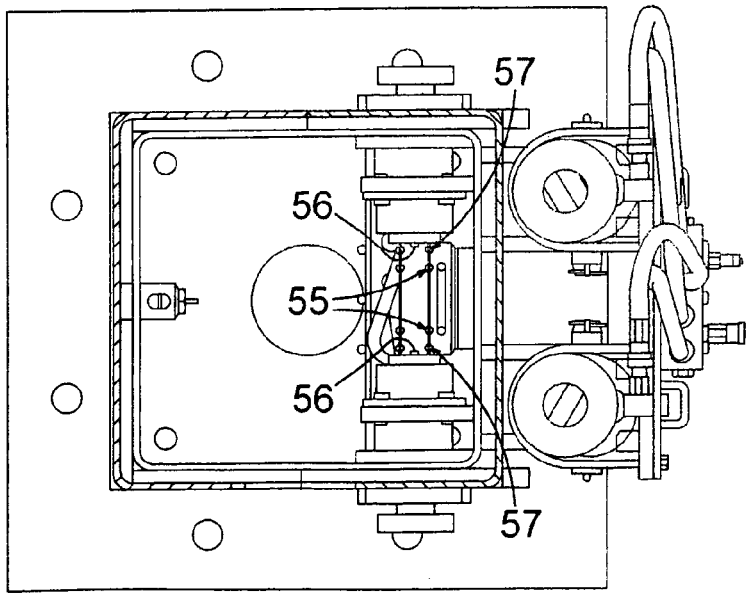
Figure 8B:
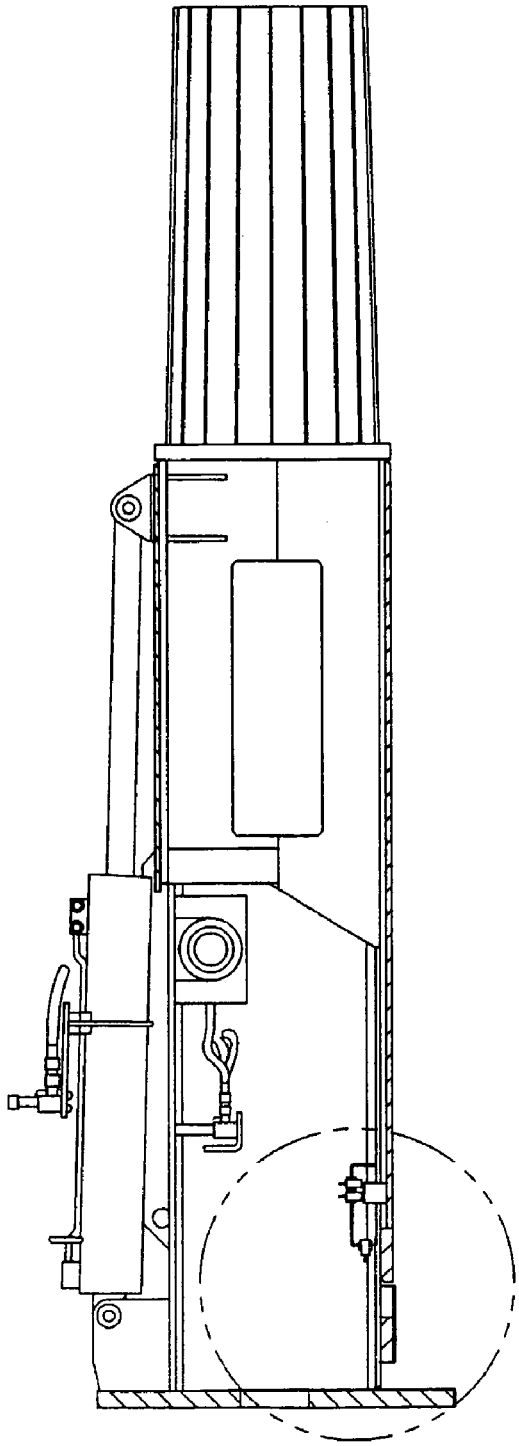
FIGS. 8*a* to 8*e* are views corresponding to FIGS. 6*a* to 6*e* in the raised, undocked and unlocked position.
Figure 8A:
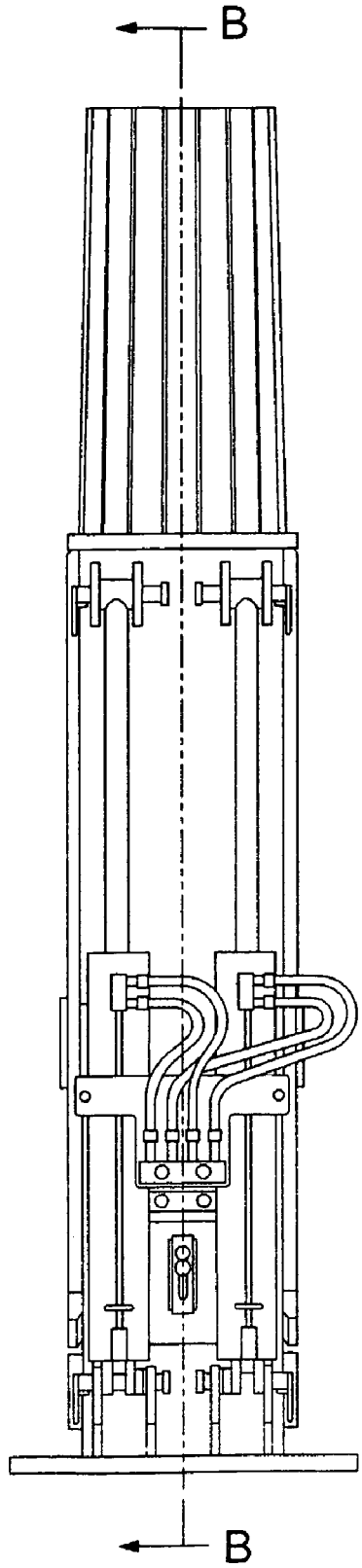
Figure 8D:
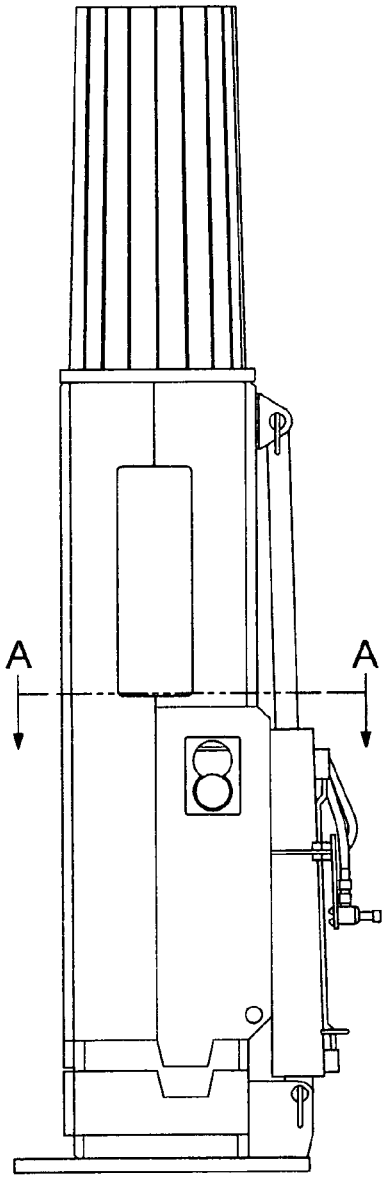
Figure 8C:
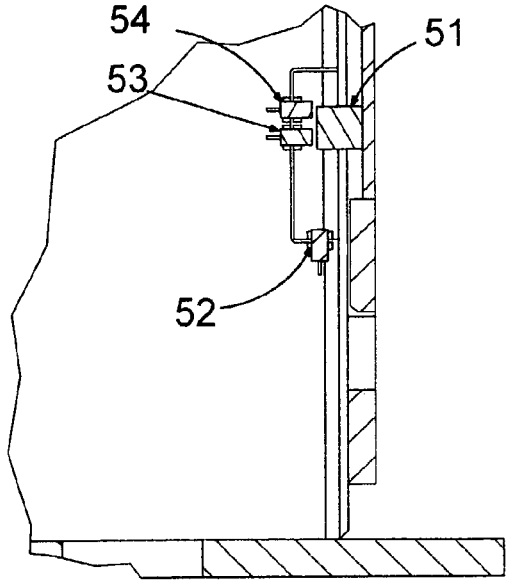
Figure 8E:
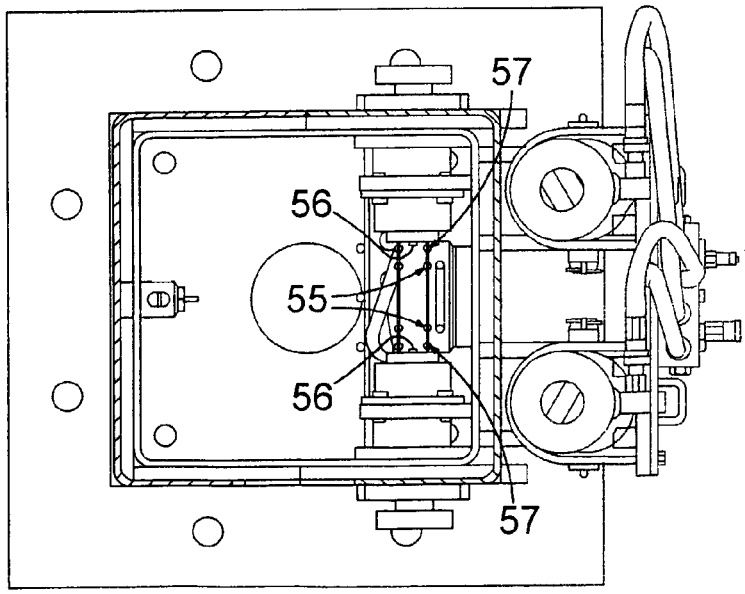
Figure 9B:
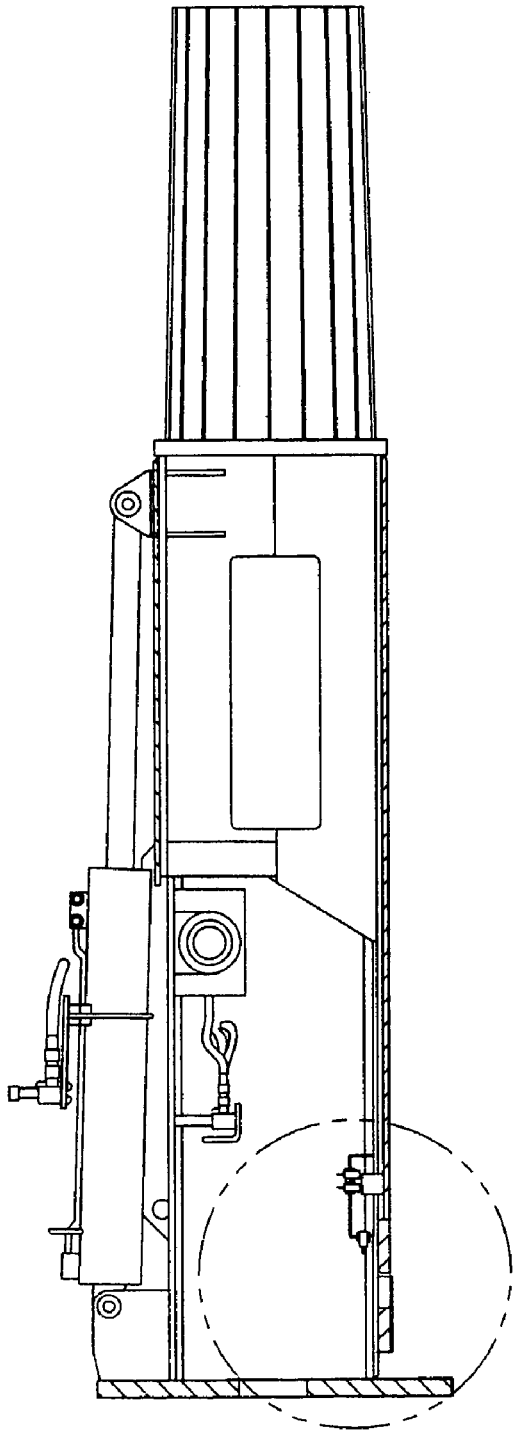
FIGS. 9*a* to 9*e* are views corresponding to FIGS. 6*a* to 6*e* in the raised, undocked and locked position.
Figure 9A:
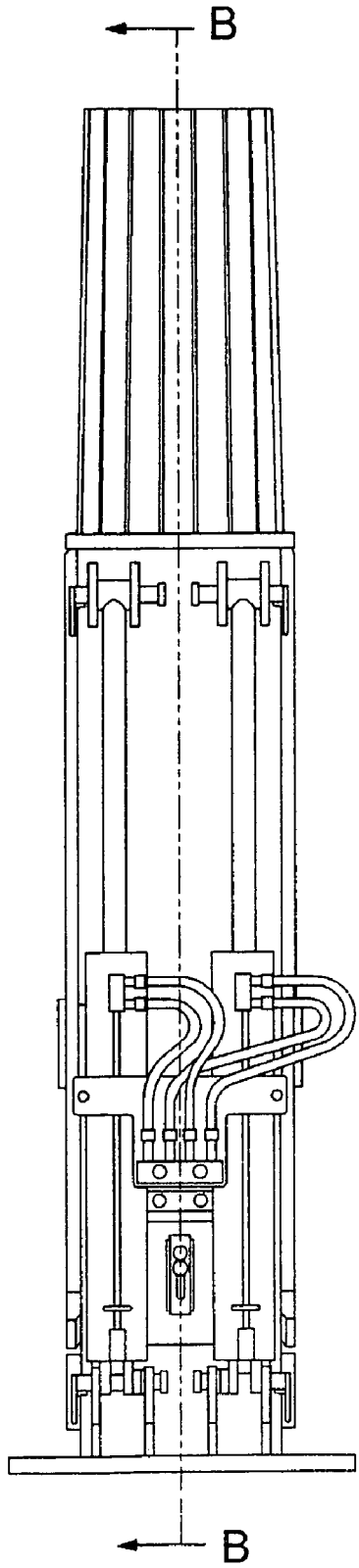
Figure 9D:
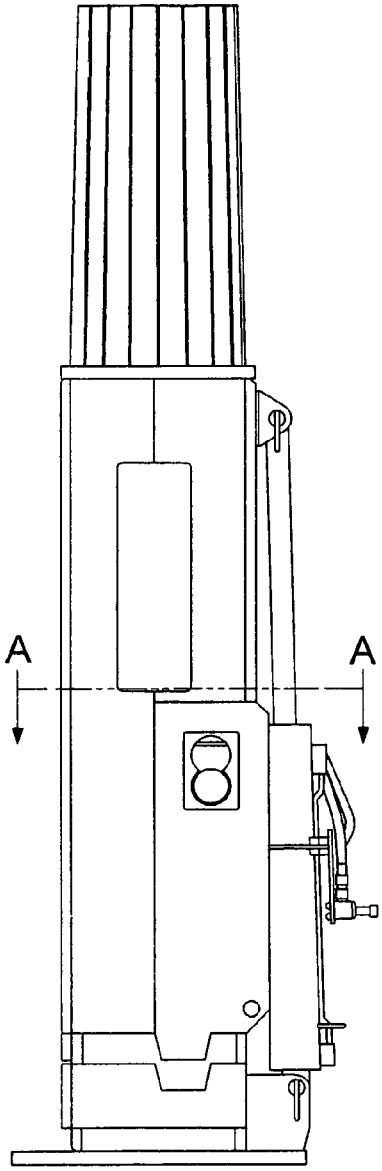
Figure 9C:
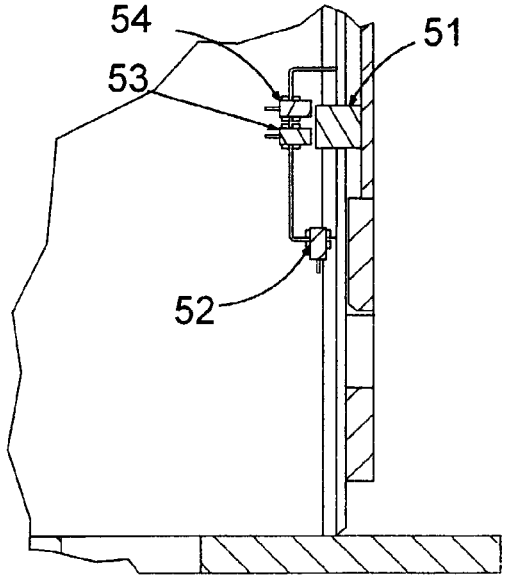
Figure 9E:
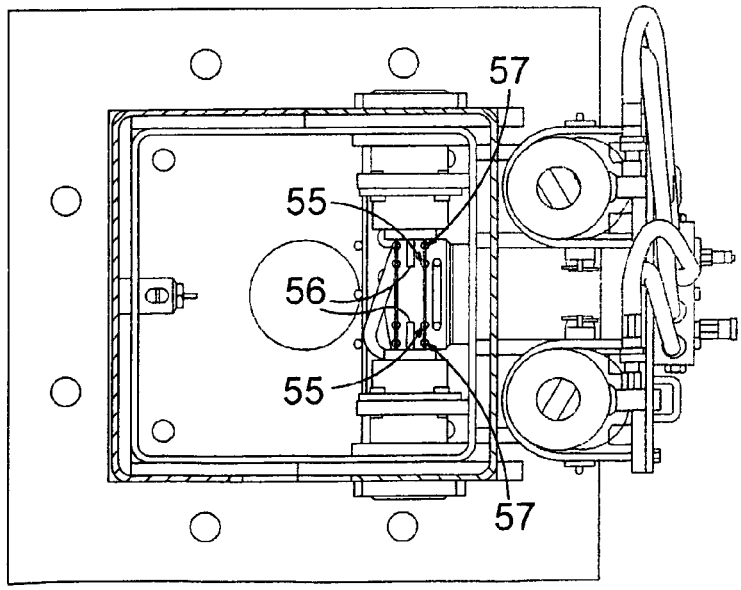
Figure 10C:
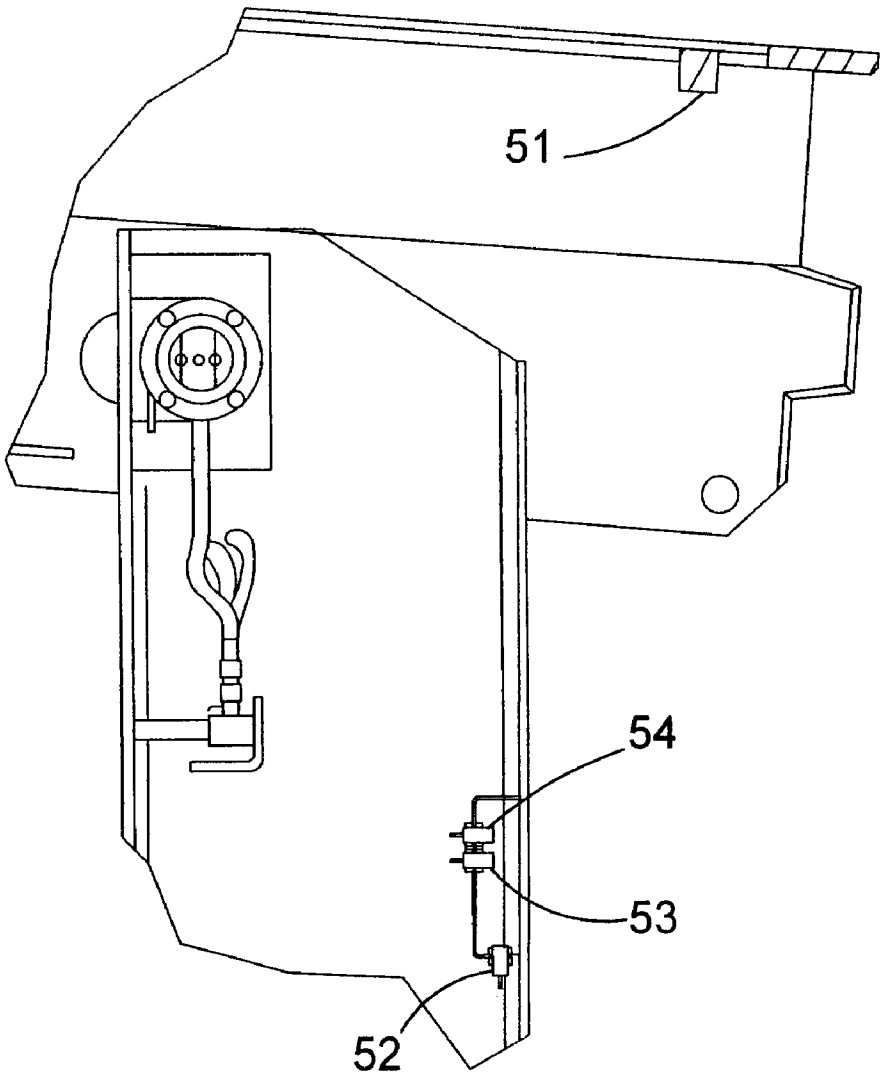
FIGS. 10*a* to 10*e* are views corresponding to FIGS. 2*a* to 2*e* in the lowered, undocked and unlocked position.
Figure 10A:
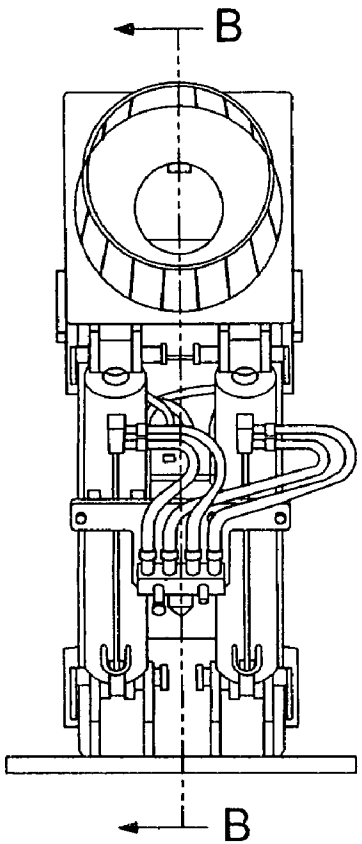
Figure 10B:
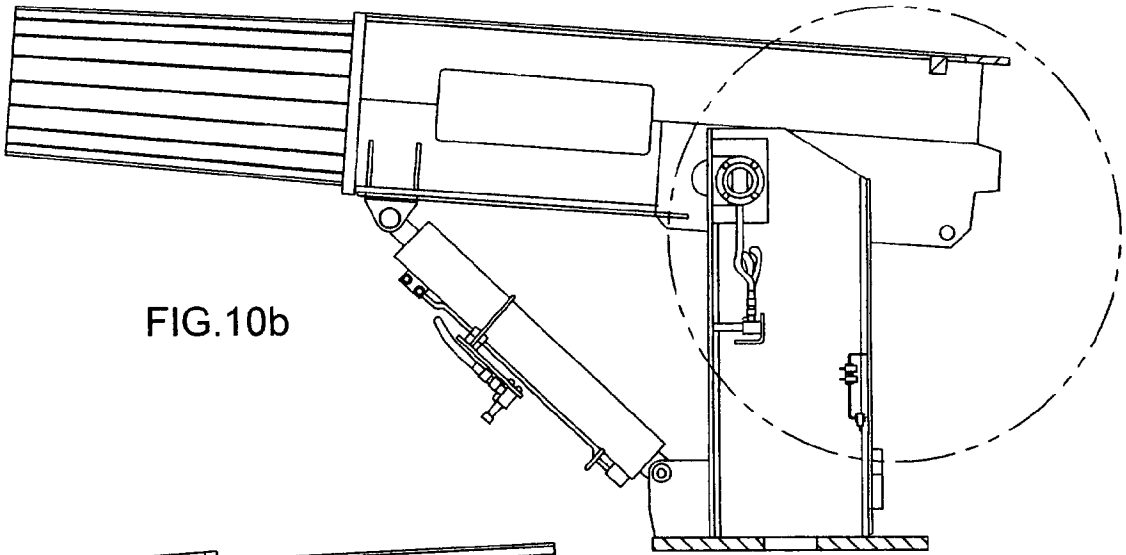
Figure 10D:
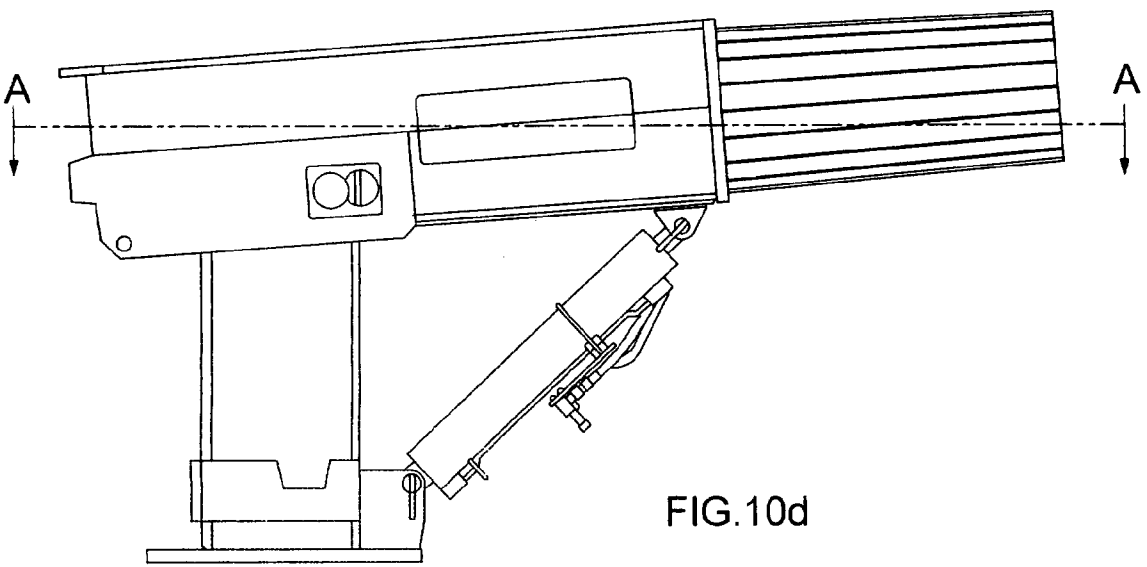
Figure 10E:
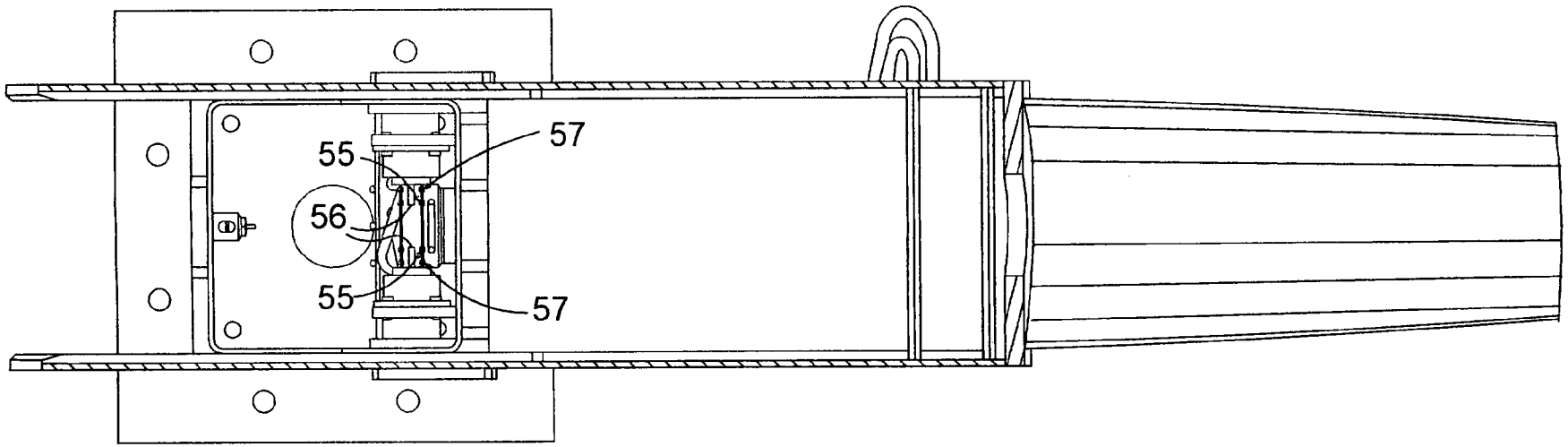

As can be seen from FIGS. 6*e* and 7*e*, a pair of cam rams 18 are located aligned on the horizontal pivot axis of the mast 10.

Each of the cam rams 18 is moveable between a first, locking position as shown in FIG. 6*d* and 6*e*, in which the cam plate 24 of the cam ram 18 is engaged in the upper cylindrical portion of the aperture 28 in the chock plate 26, and an intermediate position, which can be seem most clearly in FIG. 7*e*, in which the cam plate 24 of the cam ram 18 projects from the side wall 30 of upper base portion 6 and the shaft 22 of the cam ram 18 extends through the aperture 28.

The operation of the system will now be described with reference to FIGS. 6 to 10 of the accompanying drawings.

The normal operational position of the mast 10 is shown in FIGS. 6*a* to 6*e*. In this position, the mast 10 is raised, locked by means of the cam plate 24 in engagement with the upper circular portion of the aperture 28 in the chock plate 26. The vertical alignment of the mast 10 is checked by sensor S2 and the extension of the lift rams 36 is sensed by sensors S1, S2 and S4. The control system then extends the cam rams 18 until full extension is confirmed by the sensors S6, S7.

The position of the mast 10 is now as shown in FIGS. 7*a* to 7*e*, i.e., raised, docked and unlocked. The control system then extends the lift rams 36 so as to lift the upper mast portion 2 and the upper base portion 6 relative to the lower base portion 8 and to disengage the docking latch 12 from the notch 14. The sensors S1 and S4 confirm that the disengagement is complete.

The position of the mast 10 is now as shown in FIGS. 8*a* to 8*e*, i.e., raised, undocked and unlocked. The control system then retracts the cam rams 18 and hence the cam plates 24 into engagement with the lower circular portion of the aperture 28 and the sensors S5 and S6 confirm that the retraction is complete.

The position of the mast 10 is now as shown in FIGS. 9*a* to 9*e*, i.e., raised, undocked and locked. The control system then retracts the lift rams 36, and the mast is lowered about the horizontal pivot axis 16 until the ground proximity sensor S8 senses a predetermined proximity to the ground, and retraction of the lift rams 36 is terminated.

The mast 60 is now in the position shown in FIGS. 10*a* to 10*e*, i.e., lowered, undocked and locked.

After the required repair or maintenance work has been carried out, the lowering sequence is repeated in reverse, so as to return the mast 10 to the position shown in FIGS. 6*a* to 6*e*.

The invention claimed is:

1. A hinge mechanism comprising:

first and second chock plates and an adjustable shaft, each of the chock plates including an aperture in the form of a figure eight, having similar first and second circular portions connected by a neck portion of a width less than the diameter of the circular portions, and the shaft longitudinally adjustable between a first retracted position in which the sections of the shaft aligned with each of the chock plates have a cross-section which corresponds to the circular portions of the aperture and a second extended position in which the section of the shaft aligned with each of the chock plates have a cross-section of a diameter which is less than the width of neck portion.

2. A hinge mechanism according to claim 1, the shaft comprising:

a set of two cam rams, one ram mounted at either end of a pivot shaft, each of the cam rams comprising a cylinder, a ram shaft extending through the cylinder and slideable therein and a circular ram plate mounted on a first end of the ram shaft, the ram shaft having a diameter is less than the width of neck portion and the cam plate having a cross-section which corresponds to one of the circular portions of the figure eight aperture.

3. An arrangement for the raising and lowering of a mast, which comprises an upper mast portion and a base, wherein the upper mast portion is rotatable about a horizontal pivot axis, located in the base of the mast, the arrangement comprising:

(i) docking means for restraining the upper mast portion against rotation;

(ii) attachment for attaching drive means for driving the docking means between a first engaged configuration wherein the upper mast portion is restrained against rotation and a second disengaged configuration wherein the upper mast portion is free to rotate; and (iii) locking means selectable via an intermediate unlocked configuration between a first locked configuration wherein the docking means is engaged and a second unlocked configuration wherein the docking means is disengaged, characterized in that the locking means comprises a hinge mechanism which comprises first and second chock plates and an adjustable shaft, each of the chock plates including an aperture in the form of a figure eight having similar first and second circular portions connected by a neck portion of a width less than the diameter of the circular portions and the shaft is longitudinally adjustable between a first retracted position in which the sections of the shaft aligned with each of the chock plates have a cross-section which corresponds to the circular portion of the aperture and a second extended position in which the sections of the shaft aligned with each of the chock plates have a cross-section of a diameter which is less than the width of neck portion.

4. An arrangement according to claim 3 characterized in that the shaft comprising:

a set of two cam rams, one ram mounted at either end of a pivot shaft, each of the cam rams comprising a cylinder, a ram shaft extending through the cylinder and slideable therein and a circular cam plate mounted on a first end of the ram shaft, the ram shaft having a diameter which is less than the width of neck portion and the cam plate having a cross-section which corresponds to a circular portion of the figure eight aperture.

* * * * *